United States Patent [19]

Mori et al.

[11] Patent Number: 4,936,087

[45] Date of Patent: Jun. 26, 1990

[54] BELT TYPE FALSE TWISTING DEVICE

[75] Inventors: Hideshi Mori, Joyo; Hisaaki Kato, Shiga, both of Japan

[73] Assignee: Murata Kikai Kabushiki Kaisha, Kyoto, Japan

[21] Appl. No.: 272,072

[22] Filed: Nov. 16, 1988

[30] Foreign Application Priority Data

Nov. 19, 1987 [JP] Japan ..... 62-292692
Jan. 9, 1988 [JP] Japan ..... 63-1582[U]

[51] Int. Cl.[5] ..... D01H 1/11; D01H 1/115; D02G 1/04

[52] U.S. Cl. ..... 57/328; 57/331; 57/336; 57/348

[58] Field of Search ..... 57/328, 336, 348, 331

[56] References Cited

U.S. PATENT DOCUMENTS

| | | | |
|---|---|---|---|
| 3,659,408 | 5/1972 | Burr | 57/336 X |
| 4,047,373 | 9/1977 | Takai | 57/336 |
| 4,144,701 | 3/1979 | Takai et al. | 57/336 |
| 4,248,038 | 2/1981 | Takai | 57/348 X |
| 4,400,931 | 8/1983 | Maeda | 57/336 |
| 4,674,274 | 6/1987 | Kato | 57/328 |

*Primary Examiner*—John Petrakes
*Attorney, Agent, or Firm*—Spensley, Horn, Jubas & Lubitz

[57] ABSTRACT

A belt type false twisting device for a pneumatic spinning apparatus in which a fiber bundle is nipped between a pair of endless belts running in an intersecting relationship in mutually different directions to impart false twists to the fiber bundle. A pulley around which each of the endless belts extends is supported for rocking motion around a support shaft.

19 Claims, 3 Drawing Sheets

BELT TYPE FALSE TWISTING DEVICE

FIELD OF THE INVENTION

This invention relates to a belt type false twisting device for nipping a yarn between a pair of belts extending in an intersecting relationship in mutually different directions to apply false twists to the yarn.

RELATED ART STATEMENT

Such a belt type false twisting device as described above imparts false twists to a yarn by causing, for example, as shown in FIG. 6, yarn Y to run through an intersecting point (nip point) N of a pair of endless belts 7 and 8 which extend between and around pulleys 3, 4 and 5, 6 which are provided projectingly for rotation from a pair of frames 1 and 2 extending perpendicularly to each other.

As one of the pulleys 4 or 6 is normally urged to the belt tensioning side by tension devices 9 normally provided on the frame 1 or 2, the belts 7 and 8 of the belt type false twisting device are acted upon by a substantially fixed tensile force even if the belts 7 and 8 are bent at the nip point. Reference symbol 2*a* denotes a slide frame section mounted for parallel movement along a guide rod 12 on the frame body 2, and support shafts 10 for the one pulleys 4 and 6 are provided uprightly on the slide frame section 2*a*. Reference numeral 11 denotes a coil spring for urging for tensioning.

And, it is a very important factor for processing of a yarn from the following points that a fixed tension is always applied to the belts in such a manner as described above.

In particular, if it is intended to apply false twists stably to the running yarn Y, then the contacting pressure of the belts with the yarn Y must be stabilized, and to this end, when the running yarn Y varies in thickness, the belts 7 and 8 must be moved toward or away from each other to change the distance between them at the position of the nip point N by a distance corresponding to an amount of such variation. In case the movement of the belts 6 and 8 toward or away from each other is not performed smoothly, such an inconvenience is caused that the contacting pressure of the belts 7 and 8 with a thick fiber portion of the yarn will be increased (the tensile force of the belts themselves will be increased) so that the number of twists to be applied to the yarn Y will be increased, but the contacting pressure of the belts 7 and 8 with a thin fiber portion of the yarn will be decreased (the tensile force of the belts themselves will be reduced) so that the number of twists to be applied to the yarn will be decreased.

Such circumstances as described above are a great problem also where a belt type false twisting device of this type is used for false twisting of a yarn of chemical filaments, and particularly where the device is used as a false twist applying device for a spinning apparatus wherein a fiber bundle of slivers or roving consisting of aggregates of short fibers is used as a raw material, the circumstances are a greater problem.

In particular, the degree of variation in thickness of a fiber bundle is greater than that of a filament yarn of chemical fiber, and besides, with a fiber bundle which is an aggregate of short fibers, an increase of number of twists will immediately cause a yarn breakage but a decrease of number of twists will immediately cause a spinning disabling condition.

While it is desirable in a belt type false twisting device that the tensile force applied to belts be fixed and unchanged even if the belts are bent at some portions of running paths thereof (a bend or the like particularly at a nip point N by mutually contacting pressure) as described above, because the conventional device shown in FIG. 6 employs a slide mechanism, the resistance against movement of the slide frame section 2*a* cannot be fixed, and hence the stability of the tensile force cannot be attained.

In particular, a sliding body supported for sliding movement on a guide rod is generally acted upon by a sliding resistance which varies with some hysteresis. Even with the conventional device, if the belts are bent, for example, at the nip point so that the pulleys 3 and 4 are acted upon by a stress to tend to reduce the distance between them, a high statical friction acts between the guide rod 12 and the slide frame section 2*a* so that the movement of the pulley 4 cannot be performed smoothly. Consequently, a high tension may appear in the belt 7. Or on the contrary, while the distance between the pulleys 3 and 4 must be increased by the tensioning force of the coil spring 11 when the belts which have once been bent at the nip point are to be returned into a straightened condition, a high statical friction acts similarly as described above so that the movement of the pulley 4 is not performed smoothly. Consequently, the belt 7 tends to be slackened so that the tension thereof is lowered suddenly. The conventional device has such drawbacks as described just above.

And, even if such a slide mechanism as described above can be changed to some other mechanism having a lower frictional resistance, the tensile force of a belt has a very delicate influence on a false twisting action of a yarn as described hereinabove. Accordingly, even if the tensile force of the belt is stable, if a mechanism by which the tensile force of the belt can be adjusted finely is not involved, it is not possible to ideally apply false twists to a yarn to perform spinning actually.

OBJECT AND SUMMARY OF THE INVENTION

It is an object of an embodiment of the present invention to provide a belt type false twisting device in which the tension applied to the belts is always kept constant to apply stable false twists to the yarn.

It is another object of an embodiment of the present invention to provide a false twisting device wherein the tension of the belts can be adjusted finely.

According to an embodiment of the present invention, a belt type false twisting device wherein fiber is nipped between a pair of endless belts running in an intersecting relationship in mutually different directions to temporarily twist the fiber is constituted such that a pulley around which each of the endless belts extends is supported for rocking motion around a support shaft which extends in parallel to a rotary shaft of the pulley.

In the belt type false twisting device according to an embodiment of the present invention, a spring is further provided for urging the rockable following pulley in a direction to move away from the other driving pulley, and besides an adjusting screw is provided for increasing or decreasing the effective length of the spring.

When a variation in tension applied to the belt tends to be caused by a bend or the like, the pulley supported for rocking motion is rocked by an amount corresponding to the amount of the bend of the belt to adjust the distance between the pair of pulleys to prevent the variation in tension from being caused.

Since such rocking motion is a motion around a single axis, the pulley is rocked smoothly in very high response even to a weak force which is caused by a bend of the belt.

The tension applied to the belt can be adjusted finely by adjusting the amount of threaded engagement of the adjusting screw to increase or decrease the effective length of the spring.

DETAILED DESCRIPTION OF PREFERRED EMBODIMENTS

In the following, an example will be described wherein a belt type false twisting device of an embodiment of the present invention is employed as a second false twisting device of a spun yarn producing apparatus.

Figure 5:
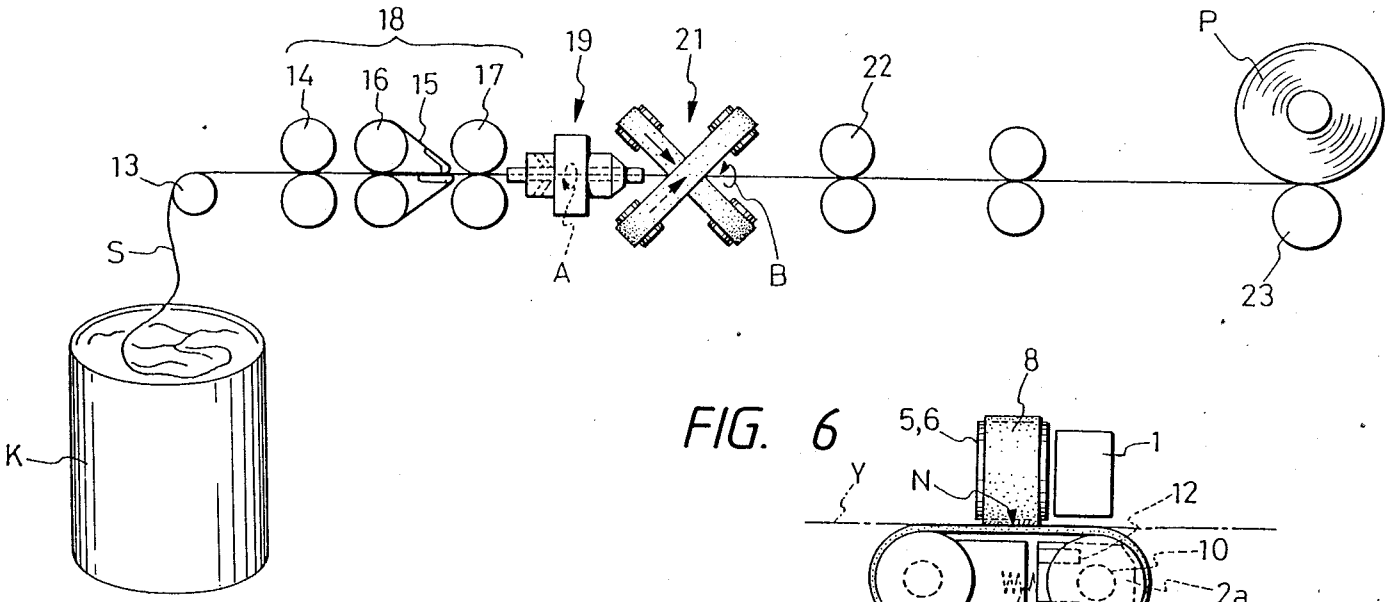
Figure 6:
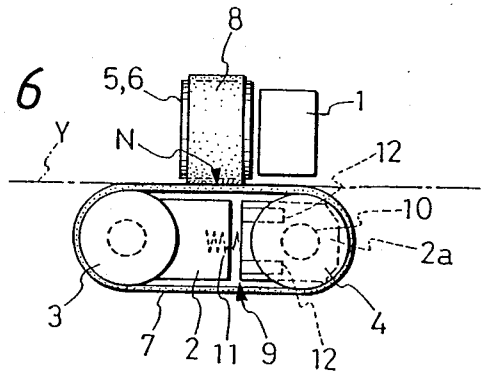

Referring to FIG. 5, an untwisted drawing sliver or fiber bundle S drawn out from a can K is fed past a guide roller 13 and then introduced into and drafted by a draft device 18 which includes a pair of back rollers 14, a pair of middle rollers 17 each having an apron 15 and a pair of front rollers 17. The fiber bundle S is further passed successively through an air jetting nozzle 19 serving as a first false twisting device and a belt type false twisting device 21 serving as a second false twisting device and is then drawn out by a pair of delivery rollers 22 whereafter it is wound onto a package P which is rotated by a friction roller 23.

The air jetting nozzle 19 jets a compressed air flow which whirls in the direction of an arrow mark A to cause the fiber bundle S drafted by the draft device 18 to be vibrated with respect to a fixed point at a nip point of the front rollers 17 to form a balloon which whirls in the same direction as the arrow mark A.

The belt type false twisting device 21 includes, as shown in detail in FIGS. 1 to 4, a pair of endless belts 24 and 25 extending in a mutually intersecting relationship in a substantially X-shape between and around driving pulleys 26 and 27 and following pulleys 28 and 29, respectively, and the individual pulleys 26, 27, 28 and 29 are supported for rotation on a pair of frames 32 and 33 in the form of arms provided projectingly from a machine frame 31, respectively. The belts 24 and 25 are driven to run in the directions indicated by arrow marks in FIG. 5 to apply false twists to a fiber bundle in the direction of an arrow mark B (FIG. 5).

The driving pulleys 26 and 27 and the following pulleys 28 and 29 are urged each by a tension device in a direction to increase the distance between them, and in the following, the tension device will be described.

In particular, each of the frames 32 and 33 is composed of a fixed frame section **32*a* or 33*a* integrally secured to the machine frame 31, and a swing frame section 32*b* or 33*b* mounted on the fixed frame section 32*a* or 33*a* for rocking motion toward and away from each other. The driving pulleys 26 and 27 are supported on the fixed frame sections 32*a* and 33*a* while the following pulleys 28 and 29 are supported on the swing frame sections 32*b* and 33*b***.

Figure 3:
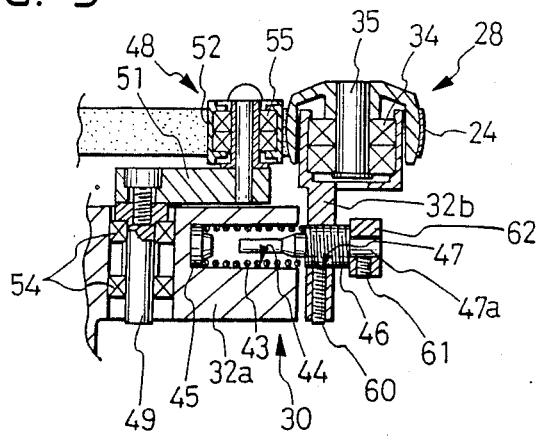
Figure 4:
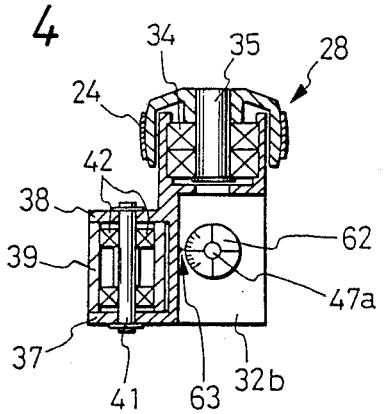

Each of the following pulleys 28 and 29 has a rotary shaft 35 supported by a bearing 34 provided at an upper portion of the swing frame section **32*b* or 33*b* as shown in FIGS. 3 and 4, and the rotary shaft 35 extends in a perfectly parallel relationship to a rotary shaft 36 of the driving pulley 26**.

And, the swing frame section **32*b* is combined with the fixed frame section 32*a* such that a pair of upper and lower plate portions 37 and 38 projected from a side portion thereof may hold therebetween from above and below a block portion 39 projected from the fixed frame section 32*a*. The swing frame section 32*b* is thus supported for pivotal motion by means of a bearing 42 around a support shaft 41 which extends through the plate portions 37 and 38 and the block portion 39. The support shaft 41 extends in parallel to the rotary shafts 35 and 36**.

A coil spring 43 is interposed in the following manner between the fixed frame section **32*a* and the swing frame section 32*b*** supported for pivotal motion in such a manner as described above.

In particular, a horizontal hole 44 is formed along a longitudinal direction in an arm-like portion of the fixed frame section **32*a* as shown in FIG. 3, and a coil spring 43 having a suitable strength is interposed between a spring seat 45 inserted at the bottom of the hole 44 and an adjusting screw 47 screwed into a threaded hole 46 in a side wall of the swing frame section 32*b* and serving also as a spring seat. The coil spring 43 normally urges the swing frame section 32*b* in a spacing direction, that is, in a direction to move away from the driving pulleys 26 and 27**.

By changing the amount of threaded engagement into the hole 46 of the adjusting screw 47 serving also as a spring seat, the effective length of the coil spring 43 can be increased or decreased so that the urging force upon the swing frame section **32*b*** may be changed and incidentally the tension to be applied to the belt may be adjusted.

The structure of the tension device 30 described above is employed similarly by the other frame 33.

It is to be noted that reference numeral 60 denotes a set screw for preventing loosening of the adjusting screw 47, and a graduation ring 62 which is fitted for fixation by another set screw 61 is provided at a smaller diameter portion **47*a* of a head portion of the screw 47**.

The graduation ring 62 is gripped and turned by fingers in a condition wherein it is integrally secured to the adjusting screw 47 by the set screw 61, and then when the tension of the belt reaches a predetermined value (whether the belt tension is equal to the predetermined value may be checked by means of a known detector such as a strain gage or else during actual spinning operation), the set screw 60 is screwed to fix the effective length of the spring 43. After then, in order that the appropriate adjusted condition may be discerned at a glance, the set screw 61 is loosened and then only the graduation ring 62 is turned until the original point on the ring 62 is aligned with the position of a mark 63 provided on the swing frame section 32b side. After completion of the setting described above, the set screw 61 is screwed again to fix the graduation ring 62 to the screw 47.

Meanwhile, the individual pulleys 26, 27 and 28, 29 are set in position, orientation and so on such that the belts 24 and 25 may spaced by a small gap from each other when they extend in a natural condition between and around the pulleys 26, 27 and 28, 29, and such an urging roller device 48 described in the following is provided between the one pulleys 26 and 28.

Figure 1:
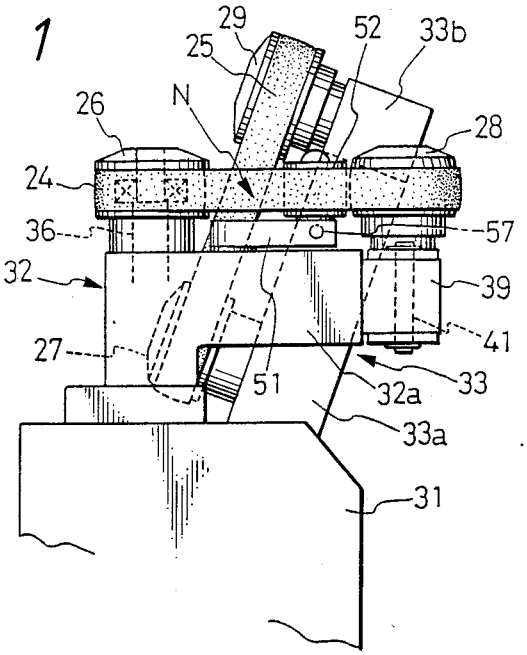
FIG. 1 is a front elevational view of a belt type false twisting device according to an embodiment of the present invention, FIG. 2 a plan view of the same, FIG. 3 a vertical sectional view of a tension device and a pressure roller, FIG. 4 a sectional view taken along line IV—IV of FIG. 2, FIG. 5 a view showing general construction of a spun yarn producing apparatus wherein a belt type false twisting device is employed as a second false twisting device, and FIG. 6 a plan view showing a conventional example.
Figure 2:
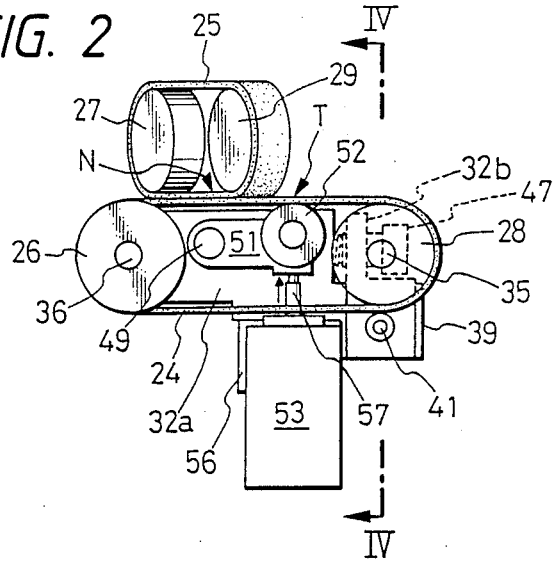

In particular, a lever 51 supported for pivotal motion around a pin 49 is provided on the one arm-like frame 32, and a roller 52 is provided for rotation at a free end of the lever 51 such that, if the lever 51 is urged in the direction of an arrow mark in FIG. 2 by an air cylinder 53, the roller 52 may be contacted in a rolling relationship on an inner face of the belt 24 to bend and move the belt 24 toward the other belt 25 side so that the belts 24 and 25 may be contacted with each other.

Reference numeral 54 denotes a bearing for supporting the pin 49 for rotation thereon, and 55 a bearing for the roller 52.

The position T at which the roller 52 is contacted in a rolling relationship with the belt 24 is set to a position spaced from the intersecting position of the belts 24 and 25, that is, the nip position N of fiber so that an urging force by the roller 52 may not be applied directly to the nip position N. As the distance of the rolling contact position T from the nip point N increases, the component of the urging force by the roller 52 which is applied directly to the nip position N decreases. Accordingly, in such a point that even a small variation in extending force of the air cylinder is reduced, it is preferable that the amount of dislocation of the rolling contact position T from the nip point N be great.

Reference numeral 56 denotes a bracket for mounting the air cylinder 53 on the frame 32a, and 57 a rod of the air cylinder.

It is to be noted that the pressure supply to the air cylinder can be changed and adjusted in multisteps or infinitely by a known means.

With the spun yarn producing apparatus described above, a fiber bundle S introduced into the belt type false twisting device 21 from the draft device 18 past the air jetting nozzle 19 is nipped between and false twisted by the belts 24 and 25, and because the fiber bundle S is an aggregate of staple and has a comparatively great degree of variation in thickness, even if the belts 24 and 25 are bent by a great amount of variation at the nip point N, the swing frame sections 32b and 33b are rocked very lightly around the shaft 41 so that the pulleys 28 and 29 are rocked delicately following such bending motion. Accordingly, the tension applied to the belts 24 and 25 is always kept constant.

Meanwhile, with the device of the present embodiment, the roller 52 for pressing against the belt is provided at the portion T spaced from the nip point N, and also by adjusting the pressing force of the roller 52, the contacting pressure between the belts can be adjusted Also from this, false twists applied to a fiber bundle can be stabilized. However, since adjustment of the pressing force of the roller 52 is effected by adjustment of pressure of air to the air cylinder 53, uniform adjustment in tension over all of a large number of units provided in a juxtaposed relationship can be effected comparatively readily by increasing or decreasing the pressure of air supply, and adjustment in tension for each of the units can be effected only by the amount of threaded engagement of the adjusting screw 47.

As described so far, with the belt type false twisting device according to an embodiment of the present invention, when a yarn is fed between the belts, the tension applied to the belts is always kept constant even if the running condition of the belts is varied by a variation in thickness of the yarn or the like. Consequently, stable false twists can be applied to the yarn and adjustment in tension of the belts can be made very accurately. Accordingly, ideal twists can be applied to the yarn.

What is claimed is:

1. A belt type false twisting device operable with a fiber bundle, the belt type false twisting device comprising:

first and second endless belts running in an intersecting relationship in mutually different directions and operable to nip the fiber bundle therebetween to impart false twists to the fiber bundle;

first and second pulleys around which the first and second endless belts extend, respectively;

first and second pulley shafts rotatably supporting the first and second pulleys, respectively; and first and second support shafts extending substantially parallel to and rockingly supporting the first and second pulley shafts, respectively.

2. A belt type false twisting device having first and second endless belts running in an intersecting relationship in mutually different directions and first and second pulley arrangements, each pulley arrangement comprising:

a pair of pulleys around which one of the first and second endless belts extend, the pair of pulleys having a following pulley and a driving pulley;

first and second pulley shafts rotatably supporting the following and driving pulleys, respectively;

a support shaft which extends substantially parallel to the first pulley shaft, for rockingly supporting the following pulley;

a spring arranged for urging the rockable following pulley in a direction to move away from the driving pulley; and an adjusting screw provided for increasing or decreasing the effective length of the spring.

3. A belt type false twisting device operable with a fiber bundle, the device comprising:

a machine frame;

first and second endless belts operable to run in an intersecting relationship, in a substantially X-shape, and arranged to nip the fiber bundle therebetween to impart false twists to the fiber bundle;

first and second sets of pulleys between which the first and second endless belts are extending, respectively each set of pulleys having a driving pulley and a following pulley;

first and second fixed frame sections secured to the machine frame and supporting the driving pulleys of the first and second sets of pulleys, respectively;

first and second swing frame sections rockingly supported by the first and second fixed frame sections, respectively, for rocking motion with respect to the first and second fixed frame sections, respectively, the first and second swing frame sections supporting the following pulleys of the first and second sets of pulleys, respectively.

4. A belt type false twisting device as claimed in claim 3, wherein each following pulley has a first rotary shaft supported by one of the swing frame sections and each driving pulley has a second rotary shaft extending substantially parallel with the first rotary shaft.

5. A belt type false twisting device as claimed in claim 4, wherein each fixed frame section has a block portion, and wherein each swing frame section has upper and lower plate portions for holding the block portion of one of the fixed frame sections therebetween, the device further comprising a support shaft extending through the plate portions of the first swing frame section and the block portion of the first fixed frame section and extending in parallel to the first and the second rotary shafts.

6. A belt type false twisting device as claimed in claim 5, wherein a coil spring is interposed between the first fixed frame section and the first swing frame section to urge the swing frame section away from the driving pulley.

7. A belt type false twisting device as claimed in claim 6, further comprising a spring seat and an adjusting screw screwed into the first swing frame section, wherein the coil spring is interposed between the spring seat and the adjusting screw so that the effective length of the coil spring can be decreased or increased by changing the amount to which the adjusting screw is screwed in the swing frame, to adjust the tension to be applied to the endless belt.

8. A belt type false twisting device as claimed in claim 7, further comprising a graduation ring provided on the adjusting screw.

9. A belt type false twisting device as claimed in claim 7, further comprising an urging roller device provided between the driving pulley and the following pulley of the first set of pulleys, at a position spaced from the intersection of the endless belts, and operable to contact the first endless belt.

10. A belt type false twisting device as claimed in claim 9, wherein the urging roller device comprises:

a lever supported for pivotal motion;

an urging roller supported by the lever;

an air cylinder connected with the lever for pivoting the lever to urge the roller to contact, bend and move the first endless belt toward the second endless belt.

11. A spinning apparatus for producing a spun yarn from an untwisted fiber bundle, the spinning apparatus having a draft device, a first false twisting device provided with an air jetting nozzle, a second false twisting device and a take-up device arranged successively, the second false twisting device comprising a belt type false twisting device operable with a fiber bundle, the belt type false twisting device comprising:

first and second endless belts running in an intersecting relationship in mutually different directions and operable to nip the fiber bundle therebetween to impart false twists to the fiber bundle;

first and second pulleys around which the first and second endless belts extend, respectively;

first and second pulley shafts rotatably supporting the first and second pulleys, respectively; and first and second support shafts extending substantially parallel to and rockingly supporting the first and second pulley shafts, respectively.

12. A spinning apparatus for producing a spun yarn from an untwisted fiber bundle, the spinning apparatus having a draft device, a first false twisting device provided with an air jetting nozzle, a second false twisting device and a take-up device arranged successively, the second false twisting device comprising a belt type false twisting device comprising:

first and second endless belts running in an intersecting relationship in mutually different directions and first and second pulley arrangements, each pulley arrangement a pair of pulleys around which one of the first and second endless belts extend, each pair of pulleys having a following pulley and a driving pulley;

first and second pulley shafts rotatably supporting the following and driving pulleys, respectively;

a support shaft which extends substantially parallel to the first pulley shaft, for rockingly supporting the following pulley;

a spring arranged for urging the rockable following pulley in a direction to move away from the driving pulley; and an adjusting screw provided for increasing or decreasing the effective length of the spring.

13. A spinning apparatus for producing a spun yarn from an untwisted fiber bundle, the spinning apparatus having a draft device, a first false twisting device provided with an air jetting nozzle, a second false twisting device and a take-up device arranged successively, the second false twisting device comprising a belt type false twisting device operable with a fiber bundle the device comprising:

a machine frame;

first and second endless belts operable to run in an intersecting relationship, in a substantially X-shape, and arranged to nip the fiber bundle therebetween to impart false twists to the fiber bundle;

first and second sets of pulleys between which the first and second endless belts are extending, respectively each set of pulleys having a driving pulley and a following pulley;

first and second fixed frame sections secured to the machine frame and supporting the driving pulleys of the first and second sets of pulleys, respectively;

first and second swing frame sections rockingly supported by the first and second fixed frame sections, receptively, for rocking motion with respect to the first and second fixed frame sections, respectively, the first and second swing frame sections supporting the following pulleys of the first and second sets of pulleys, respectively.

14. A belt type false twisting device comprising:

a first pulley;

a second pulley;

a first belt disposed about the first and second pulleys;

a first frame member rotatably supporting the first pulley; and a second frame member rotatably supporting the second pulley, the second frame member and the second pulley being rockingly supported with respect to the first frame member and the first pulley.

15. A device as claimed in claim 14, further comprising a support shaft connecting the first and second frame members and rockingly supporting the second frame member with the first frame member.

16. A device as claimed in claim 15, further comprising first and second pulley shafts for supporting the first and second pulleys, respectively, wherein the support shaft is arranged substantially parallel with at least one of the first and second pulley shafts.

17. In a belt type false twisting device having a pair of endless belts extended about a pair of pulley devices, an improved pulley device comprising:

a first frame member;

a second frame member rockingly supported with respect to the first frame member;

a first pulley rotatably supported by the first frame member; and a second pulley rotatably supported by the second frame member and rockingly supported with the second frame member, with respect to the first frame member.

18. A device as claimed in claim 17, further comprising a support shaft connecting the first and second frame members and rockingly supporting the second frame member with the first frame member.

19. A device as claimed in claim 18, further comprising first and second pulley shafts for supporting the first and second pulleys, respectively, wherein the support shaft is arranged substantially parallel with at least one of the first and second pulley shafts.

* * * * *